US006497523B1

(12) United States Patent
Kuroiwa et al.

(10) Patent No.: US 6,497,523 B1
(45) Date of Patent: Dec. 24, 2002

(54) COSMETIC STICK CONTAINER AND METHOD OF PRODUCING COSMETIC STICK IN SUCH COSMETIC STICK CONTAINER

(75) Inventors: Toshimitsu Kuroiwa, Kamakura (JP); Yoshiki Koura, Kamakura (JP); Katsumasa Kayatsu, Kamakura (JP)

(73) Assignee: Shiseido Company, Ltd., Tokyo (JP)

( * ) Notice: Subject to any disclaimer, the term of this patent is extended or adjusted under 35 U.S.C. 154(b) by 0 days.

(21) Appl. No.: 09/867,115

(22) Filed: May 29, 2001

(51) Int. Cl.[7] ..... B43K 21/02; B43K 21/027

(52) U.S. Cl. ..... 401/55; 401/49; 401/64; 401/68; 106/38.2; 424/64

(58) Field of Search ..... 401/49, 55, 58, 401/61, 63, 64, 68, 75–78.87, 88, 99, 107, 116; 424/64; 106/38.2

(56) References Cited

U.S. PATENT DOCUMENTS 4,621,935 A * 11/1986 Sussman ..... 401/68
5,183,349 A * 2/1993 Kamen ..... 401/88
5,902,061 A * 5/1999 Ackermann et al. ..... 401/68
5,954,441 A * 9/1999 Welschoff ..... 401/75
6,136,331 A * 10/2000 Morita et al. ..... 424/64

FOREIGN PATENT DOCUMENTS

JP 11290123 10/1999

* cited by examiner

*Primary Examiner*—Gregory Huson
*Assistant Examiner*—Tuan Nguyen
(74) *Attorney, Agent, or Firm*—Ladas & Parry

(57) ABSTRACT

A cosmetic stick container includes a housing sleeve, an inner sleeve provided inside the housing sleeve so as to be advanceble and retractable along a length of said housing sleeve, a cosmetic stick molded directly inside the housing sleeve having a capsule attached thereto so as to be secured to the inner sleeve, and a mold lubricant constituted of a composition having low compatibility with a composition of the cosmetic stick. The mold lubricant is applied on inner surfaces of the housing sleeve and the capsule.

6 Claims, 4 Drawing Sheets

FIG.4

| SAMPLE | EXAMPLE FOR COMPARISON | EXAMPLE |
|---|---|---|
| A | 20/30 | 0/30 |
| B | 3/30 | 0/30 |
| C | 11/30 | 0/30 |
| D | 9/30 | 0/30 |
| E | 0/30 | 0/30 |

COSMETIC STICK CONTAINER AND METHOD OF PRODUCING COSMETIC STICK IN SUCH COSMETIC STICK CONTAINER

BACKGROUND OF THE INVENTION

1. Field of the Invention

The present invention generally relates to cosmetic stick containers and methods of producing cosmetic sticks in such cosmetic stick containers, and more particularly to a cosmetic stick container that has a cosmetic stick ejected from its sleeve for use and retracted into its sleeve after use and a method of producing a cosmetic stick in such a cosmetic stick container.

2. Description of the Related Art

Conventionally, containers for lipsticks, which are cosmetic stick products, have been known as cosmetic stick containers. Such cosmetic stick containers are provided in a variety of structures. One of such cosmetic stick containers has its housing sleeve filled directly with a cosmetic stick material so that a cosmetic stick is molded in the housing sleeve.

This cosmetic stick container includes the housing sleeve, an inner sleeve, an operation part, and the cosmetic stick. The housing sleeve is cylindrical, and the cosmetic stick, which is a lipstick, an eye shadow or the like, is filled into the housing sleeve. The inner sleeve is provided inside the housing sleeve. The operation part is turnably mounted on the lower part of the outer surface of the housing sleeve.

The inner sleeve is coupled to the operation part so that turning of the operation part can raise and lower the inner sleeve inside the housing sleeve. The lower end of the cosmetic stick is secured to the inner sleeve so that the cosmetic stick is raised and lowered with respect to the housing sleeve as the inner sleeve is raised and lowered.

Therefore, by turning the operation part to raise the inner sleeve, the cosmetic stick is ejected from the open upper end of the housing sleeve so as to be applicable to the lip. On the other hand, by inversely turning the operation part to lower the inner sleeve, the cosmetic stick is retracted into the housing sleeve so as to be contained inside the housing sleeve.

The cosmetic stick is molded inside the housing sleeve at a time of producing the cosmetic stick container as follows. First, a cap is placed on the open upper end of the housing sleeve. Next, the housing sleeve is placed upside down so as to have its open upper end facing downward. Then, the cosmetic stick material melted by heat application is poured into the housing sleeve from a hole formed in the bottom portion of the operation part. With the housing sleeve being placed upside down, the bottom portion of the operation part faces upward. Thereafter, the cosmetic stick material is solidified by a given cooling treatment. At this time, the cosmetic stick material is secured to the inner sleeve to be molded into the cosmetic stick inside the housing sleeve.

This molding method does not require a molding part such as an ogive, thus dispensing with the mounting and dismounting of the ogive. Therefore, a molding process can be simplified. Further, this molding method can mold a thinner cosmetic stick than a molding method employing the ogive.

Since the above-described cosmetic stick container employs its housing sleeve to mold the cosmetic stick, the cosmetic stick is molded thinner so as to be popular among consumers as a slim-type lipstick.

However, since this cosmetic stick container directly molds the cosmetic stick inside its housing sleeve, the cosmetic stick is apt to adhere to the inner surface of the housing sleeve. Therefore, the cosmetic stick has a poor mold-release characteristic with respect to the housing sleeve, which is a fundamental problem of this cosmetic stick container.

The strong adhesion of the cosmetic stick to the inner surface of the housing sleeve is not desirable since the adhering part of the cosmetic stick becomes mat or is released poorly from the inner surface of the housing sleeve. Further, in the case of the strong adhesion of the cosmetic stick to the inner surface of the housing sleeve, stress is caused inside the cosmetic stick if the operation part is turned with strong force at a time of ejecting or retracting the cosmetic stick. This may cause the collapse or breakage of crystals of the solidified cosmetic stick material, thus making the cosmetic stick less easy to use.

Here, a lipstick is taken as the cosmetic stick. The recent demand of consumers has been made on a soft, glossy lipstick that goes smoothly on the lip. In order to satisfy this demand, it is necessary to decrease wax and increase lake and high-viscosity oil in the lipstick.

However, if wax is decreased while lake and high-viscosity oil are increased in the lipstick, the lipstick characteristically becomes soft and obtains high-viscosity. That is, an attempt to satisfy the consumer demand further deteriorates the mold-release characteristic of the lipstick, or the cosmetic stick, with respect to the inner surface of the housing sleeve of a container for the lipstick. Therefore, the above-described disadvantage is aggravated, so that the cosmetic stick may have its surface damaged and, in the worst case, be broken.

Therefore, a cosmetic stick container has been provided, which container allows a cosmetic stick included therein to have an improved mold-release characteristic with respect to the housing sleeve of the container. This is realized by applying silicon-based oil on the inner surface of the sleeve as mold lubricant at a time of molding the cosmetic stick inside the housing sleeve.

However, if the cosmetic amount formula for the cosmetic stick includes silicon-based oil, the compatibility causes the cosmetic stick to adhere to the inner surface of the housing sleeve at a cooling time or with the passage of time after molding. Therefore, the above-described disadvantage is not completely eliminated.

SUMMARY OF THE INVENTION

It is a general object of the present invention to provide a cosmetic stick container in which the above-described disadvantage is eliminated and a method of producing the same.

A more specific object of the present invention is to provide a cosmetic stick container that can reliably prevent the adhesion of a cosmetic stick to the inner surface of the container and improve the mold-release characteristic of the cosmetic stick, and a method of producing the same.

The above objects of the present invention are achieved by a cosmetic stick container including: a housing sleeve; an inner sleeve provided inside the housing sleeve so as to be advanceble and retractable along a length of the housing sleeve; a cosmetic stick molded directly inside the housing sleeve having a capsule attached thereto so as to be secured to the inner sleeve, the cosmetic stick being advanceble and retractable in accordance with advancing and retracting movements of the inner sleeve so as to be ejected from and retracted into the housing sleeve; and a mold lubricant constituted of a composition having low compatibility with a composition of the cosmetic stick, the mold lubricant being applied on inner surfaces of the housing sleeve and the capsule.

The above objects of the present invention are also achieved by a method of producing a cosmetic stick including the steps of (a) preparing a cosmetic stick container for containing the cosmetic stick, (b) applying a mold lubricant on an inner surface of a housing sleeve of the cosmetic stick container and on an inner surface of a capsule to be attached to the housing sleeve, (c) attaching the capsule on a first opening end of the housing sleeve, (d) filling a cosmetic stick material into the housing sleeve from a second opening end thereof so that the cosmetic stick material is molded into the cosmetic stick inside the housing sleeve.

According to the above-described cosmetic stick container and method of producing the same, the mold lubricant is interposed between the cosmetic stick and each of the housing sleeve and the capsule. Since the mold lubricant is constituted of the composition having low compatibility with that of the composition of the cosmetic stick, the cosmetic stick molded directly inside the housing sleeve is allowed to have a good mold-release characteristic with respect to the housing sleeve.

Therefore, the cosmetic stick is prevented from having a mat part formed on its outer surface, thus adding to the appearance of the cosmetic stick. Further, when the cosmetic stick container is used, the cosmetic stick can be advanced or retracted with a little operation force, thus making the cosmetic stick easier to use.

Further, even if the cosmetic stick is made soft to have high-viscosity to meet the demand of consumers, the high mold-release characteristic prevents the cosmetic stick from having flaws on its surface or being broken during advancing and retracting movements of the cosmetic stick. Thereby, the production yield of the cosmetic stick container is increased.

BRIEF DESCRIPTION OF THE DRAWINGS

Other objects, features and advantages of the present invention will become more apparent from the following detailed description when read in conjunction with the accompanying drawings, in which:

FIG. 4 is a diagram for illustrating results of an experiment conducted by inventors of the present invention.

DETAILED DESCRIPTION OF THE PREFERRED EMBODIMENTS

A description will now be given, with reference to the accompanying drawings, of embodiments of the present invention.

Figure 1:
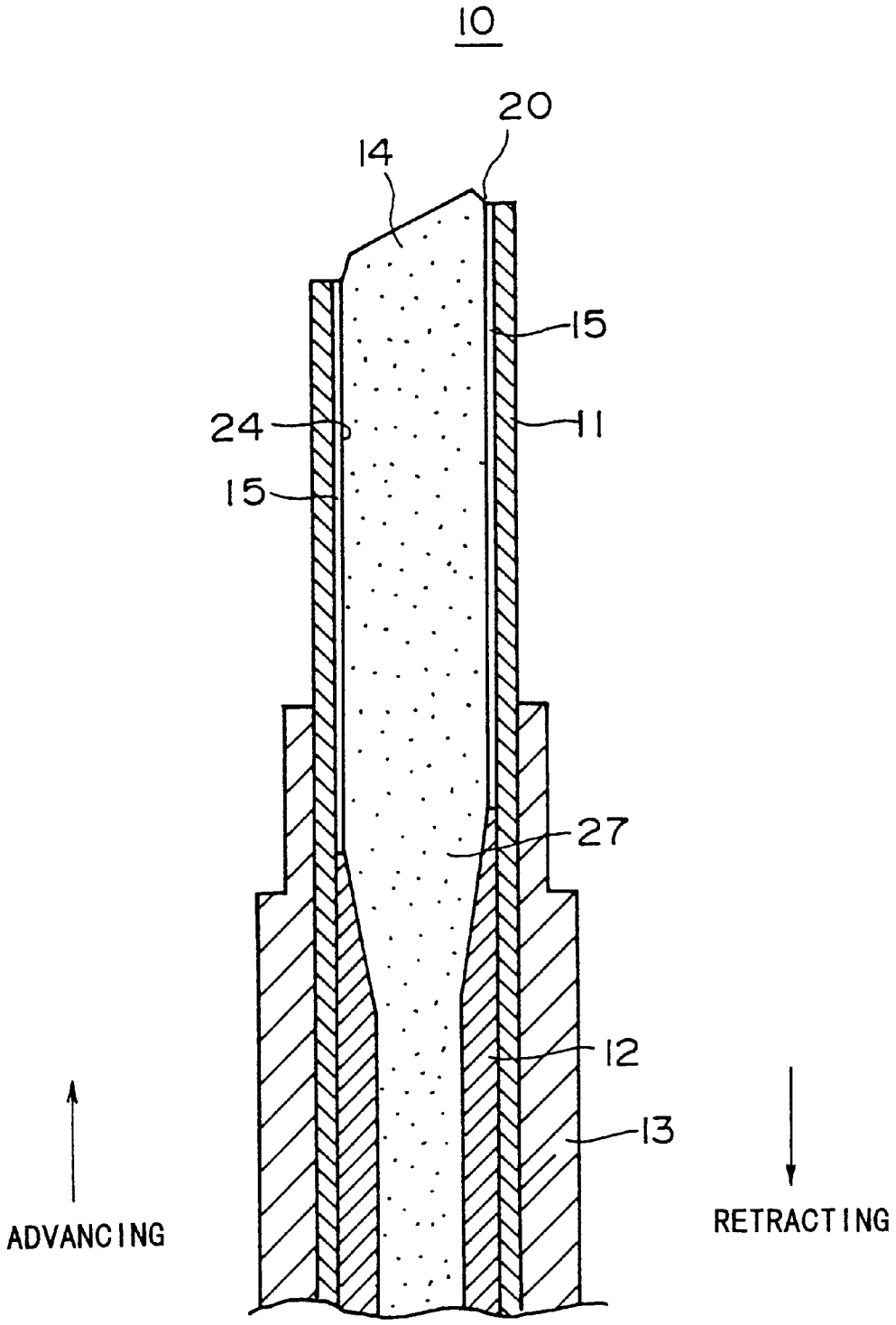
FIG. 1 is a longitudinal sectional view of a cosmetic stick container according to a first embodiment of the present invention.
Figure 2:
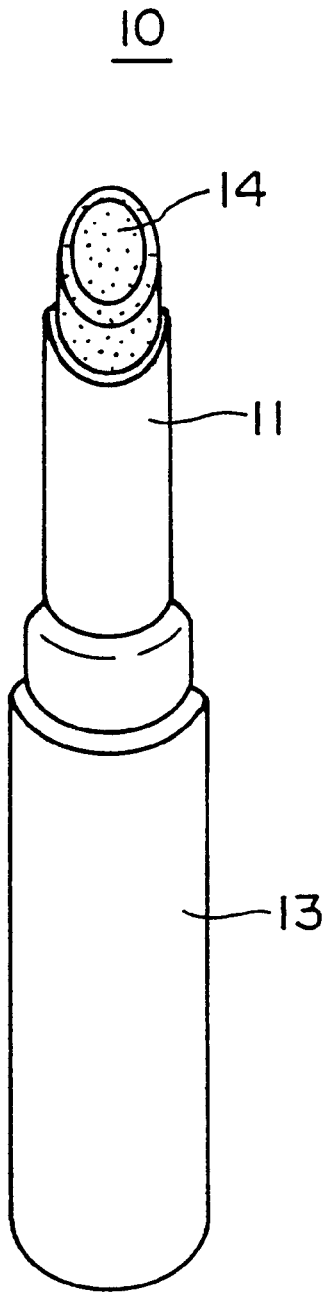
FIG. 2 is a perspective view of the cosmetic stick container.

FIGS. 1 and 2 are a longitudinal sectional view and a perspective view of a cosmetic stick container 10 according to a first embodiment of the present invention. FIGS. 3A through 3D are diagrams for illustrating a method of molding a cosmetic stick 14 in the cosmetic stick container 10 according to a second embodiment of the present invention. In the following description, the cosmetic stick container 10 is used as a lipstick container in each embodiment. However, the present invention is not limitedly applied to the lipstick container, but may be applied to containers for a variety of cosmetic sticks including an eye shadow.

The cosmetic stick container 10 includes a housing sleeve 11, an inner sleeve 12, an operation part 13, a cosmetic stick 14, and a lubricant 15. The housing sleeve 11 is cylindrical, and the cosmetic stick 14, or a lipstick, is filled into the housing sleeve 11. As shown in FIGS. 3A through 3D, projections 16 for mounting are formed on predetermined positions on the outer surface of the housing sleeve 11 to project outward therefrom. Further, a longitudinal slot 17 is formed in a predetermined position in the housing sleeve 11 to extend along the length thereof.

The inner sleeve 12 is provided inside the housing sleeve 11, and the operation part 13 is turnably mounted on the lower part of the outer surface of the housing sleeve 11. The cylindrical inner sleeve 12 is provided so as to be movable inside the housing sleeve in advancing and retracting directions indicated by arrows in FIG. 1.

A projection 18 for movement is formed in a predetermined position on the outer surface of the inner sleeve 12 to project outward therefrom. The projection 18 passes through the longitudinal slot 17 formed in the housing sleeve 11 to project outward therefrom as shown in FIGS. 3A through 3D. This structure allows the inner sleeve 12 to move within the guide range of the longitudinal slot 17 inside the housing sleeve 11.

Further, projections 19 for junction are formed in predetermined positions on the inner surface of the inner sleeve 12 to project inward therefrom. The projections 19 join the cosmetic stick 14 when the cosmetic stick 14 is molded.

The inner sleeve 12 is coupled to the operation part 13. The operation part 13 is turnably attached to the projections 16 formed on the outer surface of the housing sleeve 11. Further, a spiral groove (not shown) is formed in the inner face of the operation part 13 to engage the projection 18 projecting from the housing sleeve 11. Therefore, by turning the operation part 13, the inner sleeve 12 is moved in the advancing and retracting directions, and accordingly, the cosmetic stick 14 is moved integrally with the inner sleeve 12.

Thus, by turning the operation part 13, the cosmetic stick 14 is ejected from an upper opening 20 of the housing sleeve 11 to be applicable to the lip. On the other hand, by inversely turning the operation part 13, the cosmetic stick is retracted into the housing sleeve 11 to be contained inside the housing sleeve 11.

The cosmetic stick 14 is molded inside the housing sleeve 11 by a below-described molding method. The cosmetic stick 14 of this embodiment contains 1 to 60 percent silicon-based oil. Further, in order to be a glossy lipstick that goes smoothly on the lip, the cosmetic stick 14 is composed to include less wax and more lake and high-viscosity oil. Therefore, the cosmetic stick 14 of this embodiment is characteristically soft and of high-viscosity.

The lubricant 15 is applied at least on a part of an inner surface 24 of the housing sleeve 11 which part opposes the cosmetic stick 14. Therefore, in the cosmetic stick container 10 in a finished state, the lubricant 15 is interposed between the inner surface 24 of the housing sleeve 11 and the outer surface of the cosmetic stick 14.

A composition having low compatibility with the composition of the cosmetic stick 14 is selected as the lubricant 15. That is, since the cosmetic stick container 14 of this embodiment contains 1 to 60 percent silicon-based oil, a composition containing fluorine-based oil having low compatibility with silicon-based oil is selected as the lubricant 15.

Specifically, polytetraflouoroethylene (PTFE) is selected as fluorine-based oil. Conventionally, silicon-based oil has been used as the lubricant 15 as previously described.

Next, a description will be given, with reference to FIGS. 3A through 3D, of the method of molding the cosmetic stick 14 inside the housing sleeve 11 at the time of producing the cosmetic stick container 10 according to the second embodiment of the present invention.

Figure 3A:
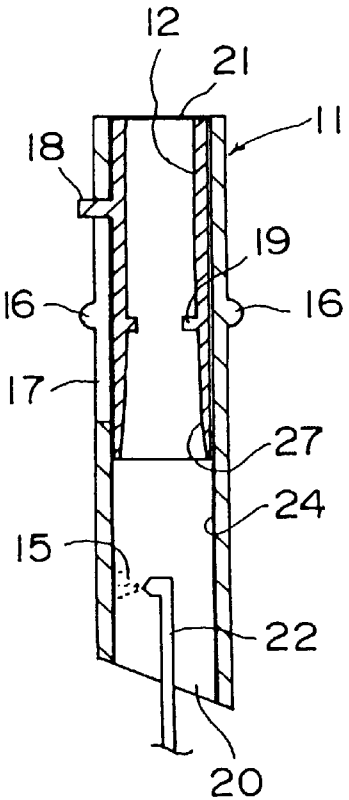
FIGS. 3A through 3D are diagrams for illustrating a method of molding a cosmetic stick in the cosmetic stick container according to a second embodiment of the present invention.

In order to mold the cosmetic stick 14, first, as shown in FIG. 3A, the lubricant 15 is applied on the inner surface 24 of the housing sleeve 11 in which the inner sleeve 12 has been provided in advance. In FIG. 3A, the lubricant 15 is applied on the inner surface 24 by using a nozzle 22 for lubricant application. However, a method of applying the lubricant 15 is not limited to the method shown in FIG. 3A.

The application density of the lubricant 15 on the inner surface 24 is adjusted to 5 to 50 g/m on average. This is because if the application density becomes lower than this range, a later-described mold-release effect may be reduced, and if the application density becomes higher than this range, the lubricant 15 may leak from the upper opening 20 of the housing sleeve 11 when the cosmetic stick container 10 is finished. Further, as previously described, the lubricant 15 is applied at least on the part of the inner surface 24 of the housing sleeve 11 which part opposes the cosmetic stick 14.

Figure 3B:
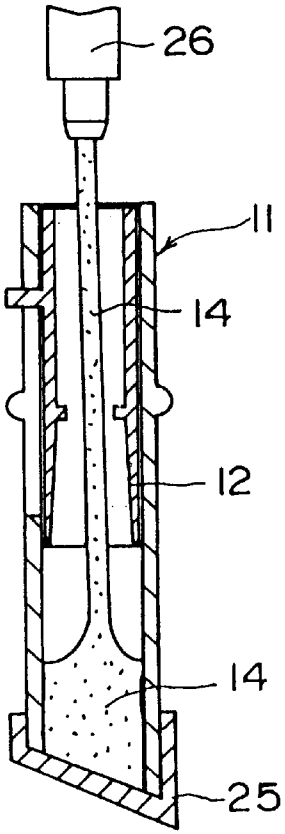

After the lubricant 15 is applied on the inner surface 24 of the housing sleeve 11 as described above, a capsule 25 is attached to cover the upper opening 20 of the housing sleeve 11 as shown in FIG. 3B. The capsule 25 is a resin cap and the same lubricant 15 that is applied on the inner surface 24 of the housing sleeve 11 is applied on the inner wall of the capsule 25 at the same application density.

Next, as shown in FIG. 3B, a cosmetic material to be molded into the cosmetic stick 14 is poured directly into the housing sleeve 11. This cosmetic material is also referred to by the numeral 14. Since both housing sleeve 11 and inner sleeve 12 are cylindrical, the housing sleeve 11 is filled with the molten cosmetic material 14 poured from a lower opening 21 of the housing sleeve 11 or of the inner sleeve 12.

Figure 3C:
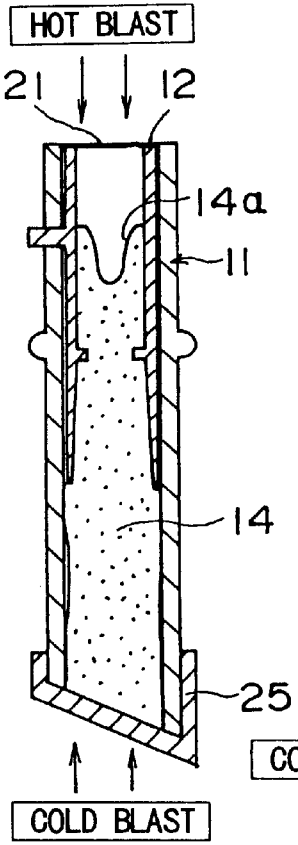

After the housing sleeve is filled with the cosmetic material 14, as shown in FIG. 3C, a cold blast is blew, for a predetermined period of time, on a side of the housing sleeve 11 on which side the capsule 25 is provided for cooling the cosmetic material 14, and at the same time, a hot blast is blew through the lower opening 21 on the cosmetic material 14 for a predetermined period of time.

Thus, not only cooling treatment but also heat treatment blowing the heat blast on an upper surface 14*a* of the cosmetic material 14 is performed on the cosmetic material 14. This is because only with the cooling treatment, the cosmetic material 14 contracts by cooling to have a contraction hole formed in an upper surface 14*a* thereof. FIG. 3C shows a state where the contraction hole is formed. However, by simultaneously performing the cooling and heat treatments as described above, the upper surface 14*a* of the cosmetic material can be made flat.

Figure 3D:
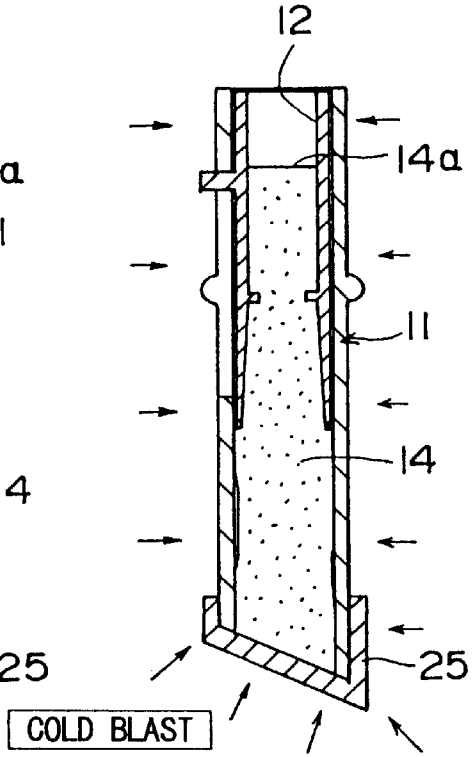

Next, in order to promote mold release, the cosmetic material 14 is completely cooled to be solidified by performing cooling treatment in which a cold blast is blew all over the housing sleeve 11 as shown in FIG. 3D. By performing the above-described treatments, the cosmetic stick 14 is directly molded inside the housing sleeve 11.

This molding method does not require a molding part such as an ogive, thus dispensing with the mounting and dismounting of the ogive. Therefore, a molding process can be simplified. Further, the cosmetic stick 14 can be molded thinner by this method than by a method employing the ogive.

As described above, the cosmetic stick 14 of this embodiment contains 1 to 60 percent silicon-based oil. Further, in order to be a glossy lipstick that goes smoothly on the lip, the cosmetic stick 14 is composed to contain less wax and more lake and high-viscosity oil to be characteristically soft and of high-viscosity. Therefore, the mold-release characteristic of the molded cosmetic stick 14 with respect to the housing sleeve 11 becomes important.

Therefore, in this embodiment, instead of a conventional lubricant whose primary constituent is silicon-based oil, a lubricant containing fluorine-based oil (PTFE) having low compatibility with silicon-based oil is employed as the lubricant 15. The inventors of the present invention conducted an experiment to verify the effects produced by employing fluorine-based oil as the lubricant 15. A description will be given below of the results of the experiment with reference to FIG. 4.

First, five types of lipsticks whose compositions were different from one another were prepared as samples A through E. Each of the five samples A through E was composed to contain 1 to 60 percent silicon-based oil, a smaller amount of wax, and a larger amount of lake and high-viscosity oil.

Then, by using the method of molding the cosmetic stick 14 described above with reference to FIGS. 3A through 3D, the five samples A through E were molded in the housing sleeves 11 of the cosmetic stick containers 10 so that 30 of the cosmetic stick containers 10 were produced with respect to each of the five types of the samples A through E. Hereinafter, the production of the 30 cosmetic stick containers 10 corresponding to one of the five types of the samples A through E is referred to as an example. Therefore, in each of the 150 cosmetic stick containers 10 in total according to the five examples, fluorine-based oil was interposed between the housing sleeve 11 and the lipstick, or the cosmetic stick 14.

On the other hand, in order to make a comparison with each of the examples, by using the same molding method as shown in FIGS. 3A through 3E except that silicon-based oil was applied as the lubricant 15 on the inner surface 24 of the housing sleeve 11 of each of the cosmetic stick containers 10, the five samples A through E were molded in the housing sleeves 11 of the cosmetic stick containers 10 so that 30 of the cosmetic stick containers 10 were produced with respect to each of the five types of the samples A through E. Hereinafter, the production of the 30 cosmetic stick containers 10 corresponding to one of the five types of the samples A through E is referred to as an example for comparison. Therefore, in each of the 150 cosmetic stick containers 10 in total according to the five examples for comparison, silicon-based oil was interposed between the housing sleeve 11 and the cosmetic stick 14.

Then, with respect to each of the 300 cosmetic stick containers 10 in total produced as described above, the mold-release characteristic and adhesiveness of the cosmetic stick 14 with respect to the housing sleeve 11 were examined.

Specifically, the mold-release characteristic of the cosmetic stick 14 with respect to the housing sleeve 11 was judged by the formation of a breakage in the cosmetic stick 14 by changing the turning force of the operation part 13 of the cosmetic stick container 10. The adhesiveness of the cosmetic stick 14 was judged by the area size of a mat or poorly-released part of the surface of the cosmetic stick 14 ejected from the housing sleeve 11.

If both mold-release characteristic and adhesiveness of the cosmetic stick 14 fall within respective predetermined ranges, the cosmetic stick 14 is determined to be an acceptable product, and if either mold-release characteristic or adhesiveness does not fall within its predetermined range, the cosmetic stick 14 is determined to be an unacceptable product. FIG. 4 shows the number of unacceptable products produced in the example and example for comparison of each of the samples A through E. That is, FIG. 4 shows the number of unacceptable products produced in the 30 cosmetic stick containers 10 with respect to each of the samples A through E.

In FIG. 4, the examples for comparison where the silicon-based oil was employed as the lubricant 15 show that an unacceptable products was not produced in the example of the sample E although the silicon-based oil was employed as the lubricant 15. However, the examples for comparison also show that a large number of unacceptable products were produced with respect to the samples A, C, and D. On the other hand, no unacceptable product was produced in the example of any of the samples A through E where the fluorine-based oil was employed as the lubricant 15.

The above-described results of the experiment show that if the fluorine-based oil is employed as the lubricant 15, the mold-release characteristic of the cosmetic stick 14 is improved and the adhesiveness thereof is reduced compared with those of the cosmetic stick 14 produced by a conventional method. This is because fluorine-based oil has low compatibility with silicon-based oil contained in the cosmetic stick 14, and fluorine-based oil itself has high lubricity.

Therefore, by employing fluorine-based oil as the lubricant 15, the cosmetic stick 14 is prevented from having a mat part formed on the surface thereof, thus adding to the appearance of the cosmetic stick 14. Further, at a time of using the cosmetic stick container 10, the cosmetic stick 14 can be advanced or retracted with a little operation force, thus making the cosmetic stick 14 easier to use.

Moreover, even if the cosmetic stick 14 is made soft with high-viscosity to meet the demand of consumers, the high mold-release characteristic prevents the cosmetic stick 14 from having flaws on its surface or being broken during advancing and retracting movements of the cosmetic stick 14. Thereby, the production yield of the cosmetic stick container 10 is increased.

In this embodiment, PTFE is employed as the fluorine-based oil. The safety of PTFE taken into a human body has been verified by a safety test conducted by the inventors of the present invention. Therefore, the safety of the cosmetic stick 14 can be secured even with PTFE adhering thereto.

The present invention is not limited to the specifically disclosed embodiments, but variations and modifications may be made without departing from the scope of the present invention.

For instance, in the above-described embodiment, the nozzle 22 is employed to apply the lubricant 15 on the inner surface 24 of the housing sleeve 11 as shown in FIG. 3A. However, as described above, a method of applying the lubricant 15 is not limited to the method shown in FIG. 3A, and any method realizing the above-described predetermined application density may be employed.

Moreover, a method of molding the cosmetic stick 14 is not limited to the one shown in FIGS. 3A through 3D, and any method molding the cosmetic stick 14 directly inside the housing sleeve 11 may be employed.

The present application is based on Japanese application No. 11-271168 filed on Sep. 24, 1999, the entire contents of which are hereby incorporated by reference.

What is claimed is:

1. A cosmetic stick container comprising:

a housing sleeve;

an inner sleeve provided inside said housing sleeve so as to be advanceable and retractable along a length of said housing sleeve;

a cosmetic stick molded directly inside said housing sleeve having a capsule attached thereto so as to be secured to said inner sleeve, the cosmetic stick being advanceable and retractable in accordance with advancing and retracting movements of said inner sleeve so as to be elected from and retracted into said housing sleeve; and a mold lubricant constituted of a composition having low compatibility with a composition of said cosmetic stick, the mold lubricant being applied on inner surfaces of said housing sleeve and the, capsule; and wherein said mold lubricant contains fluorine-based oil applied on the inner-surface of said housing sleeve at an average density of 5 to 50 $g/m^3$; and said cosmetic stick contains 1 to 60 percent silicon-based oil.

2. The cosmetic stick container as claimed in claim 1, further comprising an operation part, wherein said inner sleeve is advanced or retracted by an operation of said operation part.

3. The cosmetic stick container as claimed in claim 1, wherein said mold lubricant is applied on a part of each of the inner surfaces of said housing sleeve and the capsule, the part opposing said cosmetic stick.

4. The cosmetic stick container as claimed in claim 1, wherein:

said housing sleeve includes an opening end which said cosmetic stick is ejected from and retracted into; and the capsule is attached to cover the opening end.

5. The cosmetic stick container as claimed in claim 1, wherein the fluorine-based oil is polytetrafluoroethylene.

6. The cosmetic stick container as claimed in claim 1, wherein the fluorine-based oil is applied on the inner surface of the capsule at the same density as that for said housing sleeve.

* * * * *